US008088698B2

(12) United States Patent
Polegato Moretti

(10) Patent No.: US 8,088,698 B2
(45) Date of Patent: Jan. 3, 2012

(54) FABRIC, PARTICULARLY FOR ITEMS OF CLOTHING AND SHOES

(75) Inventor: Mario Polegato Moretti, Crocetta Del Montello (IT)

(73) Assignee: GEOX S.p.A., Montebelluna (IT)

( * ) Notice: Subject to any disclaimer, the term of this patent is extended or adjusted under 35 U.S.C. 154(b) by 498 days.

(21) Appl. No.: 12/293,375

(22) PCT Filed: Mar. 13, 2007

(86) PCT No.: PCT/EP2007/002200

§ 371 (c)(1), (2), (4) Date: Sep. 17, 2008

(87) PCT Pub. No.: WO2007/107264

PCT Pub. Date: Sep. 27, 2007

(65) Prior Publication Data

US 2009/0104404 A1 Apr. 23, 2009

(30) Foreign Application Priority Data

Mar. 21, 2006 (IT) ..... PD2006A0098

(51) Int. Cl.
*D04H 1/00* (2006.01)
*D04H 13/00* (2006.01)
*D04H 3/00* (2006.01)

(52) U.S. Cl. ..... 442/414; 428/167; 428/170; 442/239; 442/243; 442/244; 442/381

(58) Field of Classification Search ..... 442/239, 442/243, 244, 381, 414; 428/167, 170
See application file for complete search history.

(56) References Cited

U.S. PATENT DOCUMENTS

| | | | | |
|---|---|---|---|---|
| 5,500,270 | A * | 3/1996 | Langdon et al. | 428/119 |
| 5,735,145 | A | 4/1998 | Pernick | |
| 5,746,013 | A | 5/1998 | Fay, Sr. | |
| 6,263,511 | B1 * | 7/2001 | Moretti | 2/97 |
| 2002/0184927 | A1 | 12/2002 | Moretti | |
| 2005/0075027 | A1 * | 4/2005 | Etchells et al. | 442/205 |

FOREIGN PATENT DOCUMENTS

| | | |
|---|---|---|
| DE | 196 35 170 | 9/1997 |
| GB | 2 430 443 | 3/2007 |
| WO | 96 32526 | 10/1996 |
| WO | 2005 011417 | 2/2005 |

* cited by examiner

*Primary Examiner* — Norca L Torres Velazquez
(74) *Attorney, Agent, or Firm* — Oblon, Spivak, McClelland, Maier & Neustadt, L.L.P.

(57) ABSTRACT

A fabric, particularly for items of clothing and shoes, including: a first inner layer, to be directed toward the body of the user, which is substantially hydrophobic and breathable and suitable to direct liquid-phase and vapor-phase perspiration away from the user of an item of clothing or the like produced with the fabric, a second intermediate spacing layer, which is substantially hydrophobic and transfers the liquid-phase perspiration from the first inner layer toward a third outer layer and defines preferential passages for vapor-phase perspiration from the first layer outwardly, and a third outer layer, which is substantially hydrophilic and suitable for permeation of vapor-phase perspiration, for absorbing liquid-phase perspiration that arrives from the first layer, and for distributing the liquid-phase perspiration over a large surface thereof so that it can evaporate outwardly.

29 Claims, 6 Drawing Sheets

FABRIC, PARTICULARLY FOR ITEMS OF CLOTHING AND SHOES

The present invention relates to an improved fabric particularly for items of clothing and shoes.

BACKGROUND OF THE INVENTION

Items of clothing are currently known and widely appreciated commercially which are characterized in that they comprise a protective outer envelope and an inner layer which forms an interspace with access holes at the regions of the body where perspiration is generated the most.

The provision of such an item of clothing is disclosed in the documents WO 0101803, EP 1194049 and U.S. Pat. No. 6,263,511, of the same Inventor.

The items of clothing thus produced allow convection of the warm air and vapor normally produced by the body and allow to expel them outwardly by means of holes located in the top region of the items of clothing; devices which keep out water, impurities and others are located at said holes.

Although these items of clothing are appreciated, they have shown limitations which have prevented their even greater diffusion.

The provision of items of clothing with a structure as described above is in fact rather complex and expensive, requiring many operations for cutting and sewing together the different fabrics that constitute the system (at least two: an outer envelope and a layer which forms the interspace, but usually three, including an internal lining, which is substantially always present.).

Often, moreover, said items of clothing do not have a particularly good fit, much less a particular visual impact, and are not always acceptable from an aesthetic standpoint. They appear to be bulkier and more rigid than normal items of clothing of the same type and at the same time make the movements of wearers more difficult.

Even more so, the structure of the item of clothing according to the documents cited above is not suited for items which must have high qualities of softness and comfort, such as knitwear and in particular underwear; these items in fact require particularly soft and physiologically effective fibers.

Another limitation which has been observed is due to the fact that current structures are unable to eliminate any condensed perspiration which has become a liquid, since the interspace is provided with fibers which are not provided specifically for this purpose.

In order to obviate these drawbacks, in the documents EP-1266584, US 2002184927, of the same Inventor, a fabric is disclosed for items of clothing and shoes having a structure which is characterized in that it comprises:

an inner layer, which acts as a lining and comprises material capable of distributing any condensed perspiration over a large surface, an intermediate spacing layer, which comprises material capable of transferring outwardly the perspiration that has condensed inside the item of clothing, an outer layer, which comprises material which is capable of distributing condensed perspiration over a very large surface so as to cause its immediate evaporation and consequently regenerate the entire system.

These layers are integrated so as to form a single element.

Although this fabric provides the required improvements of greater comfort, better fit, and simple and inexpensive manufacture and working, it also has aspects which can be improved.

In particular, the inner layer, which is substantially hydrophilic, on the one hand facilitates the distribution of the condensed water vapor over a large surface but on the other hand does not facilitate the escape of the vapor toward the outside of said fabric.

Moreover, such intermediate spacing layer, though being made of fibers which can convey water and vapor and/or vapor without absorbing it and are therefore substantially hydrophobic, is arranged with continuity so as to affect substantially the entire surface of the inner layer.

In this manner, any vapor that passes through the inner layer would have to pass through an intermediate layer which has hydrophobic characteristics but is densely packed with fibers which hinder its outward escape, facilitating unwanted condensation inside or on such fabric.

SUMMARY OF THE INVENTION

The aim of the present invention is to provide an improved fabric particularly for items of clothing and shoes which is capable of better perspiration and vapor dissipation with respect to the fabric cited above and with respect to the other similar known types of fabrics.

Within this aim, an object of the present invention is to provide an improved fabric which has a better fit and is physiologically more comfortable.

Another object of the present invention is to provide an improved fabric which can be adopted to provide the most disparate items of clothing, from technical gear for mountain sports to winter jackets or sports jackets and even underwear.

Another object of the present invention is to provide an improved fabric which allows natural thermoregulation of the body of the user of the item obtained with the fabric according to the invention.

Still another object of the present invention is to provide an improved fabric which can be manufactured inexpensively with known systems and technologies.

This aim and these and other objects, which will become better apparent hereinafter, are achieved by an improved fabric particularly for items of clothing and shoes, characterized in that it comprises:

a first inner layer, to be directed toward the body of the user, which is substantially hydrophobic and breathable and is suitable to direct liquid-phase and vapor-phase perspiration away from the user of an item of clothing or the like produced with said fabric, a second intermediate spacing layer, which is substantially hydrophobic and transfers the liquid-phase perspiration from said first inner layer toward a third outer layer and defines preferential passages for vapor-phase perspiration from said first layer outwardly, a third outer layer which is substantially hydrophilic and is suitable for permeation of vapor-phase perspiration, for absorbing liquid-phase perspiration that arrives from the first layer, and for distributing said liquid-phase perspiration over a large surface thereof so that it can evaporate outwardly, said layers being joined so as to form a single body.

BRIEF DESCRIPTION OF THE DRAWINGS

Further characteristics and advantages of the invention will become better apparent from the description of four preferred but not exclusive embodiments thereof, illustrated by way of non-limiting example in the accompanying drawings, wherein.

DESCRIPTION OF THE PREFERRED EMBODIMENTS

Figure 1:
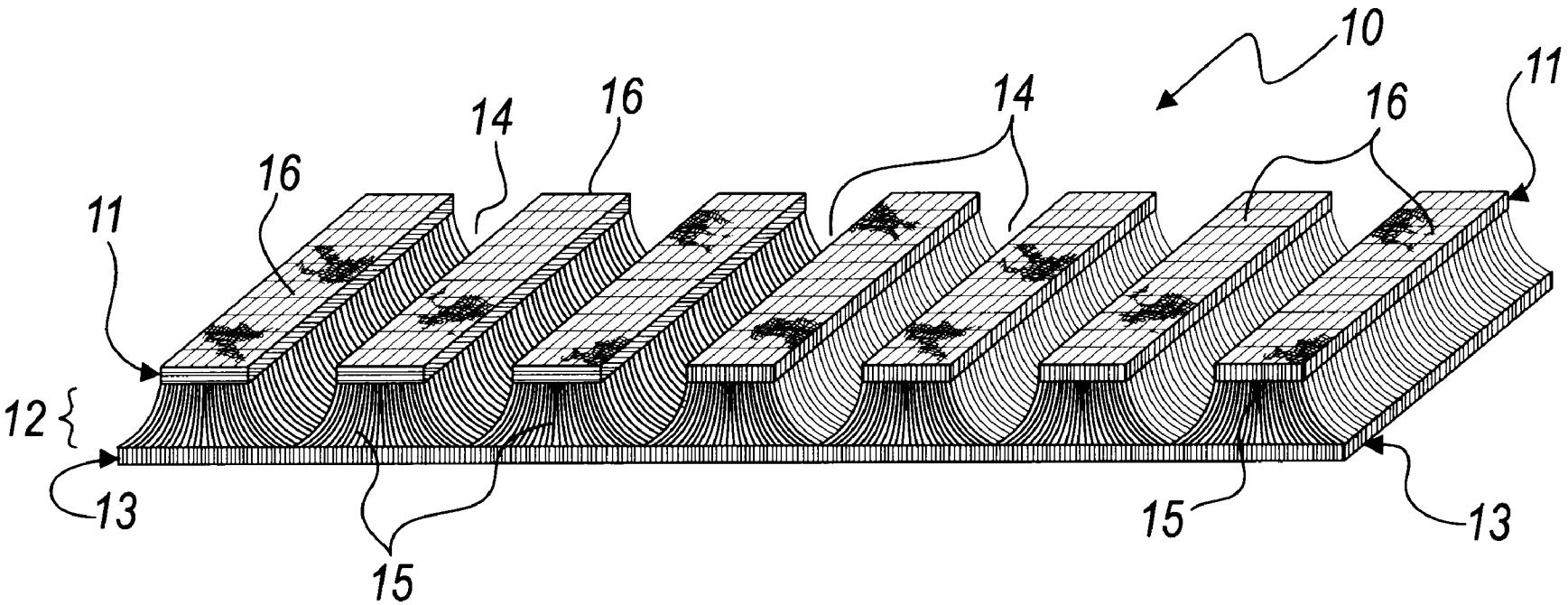
FIG. 1 is a schematic perspective view of an improved fabric according to the invention, in a first embodiment thereof.

With reference to the figures, an improved fabric particularly for items of clothing and shoes according to the invention is generally designated by the reference numeral 10 in a first embodiment, which is shown in FIG. 1.

Said improved fabric 10 comprises:

a first inner layer 11, which is to be directed toward the body of the user and is substantially hydrophobic and breathable and is suitable to carry vapor-phase perspiration and liquid-phase perspiration away from the user of an item of clothing produced with said fabric 10, a second substantially hydrophobic intermediate spacing layer 12, for transferring liquid-phase perspiration from the first inner layer 11 toward a third outer layer 13, said second layer 12 forming preferential passages, described in greater detail hereinafter, for the passage of the vapor-phase perspiration from the first layer 11 toward the outside, a third outer layer 13, which is substantially hydrophilic and is suitable for permeation of vapor-phase perspiration, absorption of liquid-phase perspiration that arrives from the first layer 11, and distribution of said liquid-phase perspiration over its surface so that it can evaporate outwardly.

Said first layer 11, said second layer 12 and said third layer 13 are joined so as to form a single body.

In said first embodiment of the invention, the preferential passages formed on the second intermediate layer 12 are provided by a plurality of channels 14 formed by a plurality of parallel ribs 15.

The channels 14, particularly if arranged predominantly vertically with respect to a configuration for use of the item of clothing to which the fabric 10 belongs, are adapted to facilitate the rise of vapor-phase perspiration from the lower region of the item of clothing upwardly.

The hot and humid air produced by perspiration in fact tends to expand naturally due to its heat and to always move from a lower region upwardly (stack effect).

In the first embodiment of the improved fabric 10 according to the invention, the first inner layer 11 is formed by strips of hydrophobic fabric 16, each of which is arranged so as to affect a corresponding rib 15.

The first layer 11, and therefore the strips 16 that compose it, is preferably made of hydrophobic fibers of polyester or polypropylene or optionally other equivalent hydrophobic fibers.

In particular, the first layer 11 is made of polyester monofilaments, with a fiber gage of approximately 150 denier.

The second intermediate layer 12 is made of hydrophobic polyester or polypropylene or of other equivalent hydrophobic fibers.

In particular, the second hydrophobic layer 12 is a monofilament polyester fabric with a fiber gage of approximately 30 denier.

Said monofilaments of the second layer 12 are interwoven with the strips 16 of the first layer 11 and with the third layer 13 so as to form the ribs 15.

The ribs 15 of the second layer 12, joined to the corresponding strips 16 of the first layer 11, have a thickness of no less than 2 millimeters and preferably in the range from 3 to 4 millimeters.

The strips of fabric 16 of the first layer 11 have a width of no less than 2 millimeters and no more than 6 millimeters and preferably a width of approximately 4 millimeters.

At the same time, the channels 14 have an average width, between two successive ribs 15, of 3 to 8 millimeters, with a preferable average width of 4 millimeters.

The third layer 13, which is breathable and substantially hydrophilic, contains fibers of at least one material selected among cotton, linen, cellulose, plastics or other equivalent fibers.

In particular, said third layer 13 contains modified polyamide fibers, such as for example 6-nylon or 66-nylon.

As an alternative, said third hydrophilic layer 13 contains mixed composite fibers of modified polyamide and polyester or a combination of first mixed-fiber monofilaments with second monofilaments made of polyester.

Said first mixed-fiber monofilaments can be for example made of modified polyamide and polyester, with second monofilaments made of polyester.

The first mixed-fiber monofilaments preferably have a fiber gage of approximately 90 denier, while the second monofilaments made of polyester preferably have a fiber gage of approximately 150 denier.

In general, the fibers are modified in order to have a hydrophilic characteristic, by causing a chemical modification of the polymeric chain during polymerization or by inserting chemically hydrophilic sites within or as ramifications of the polymeric chain. As an alternative, it is possible to perform chemical treatments on the fibers so as to attach the hydrophilic sites to their surface.

The improved fabric 10 according to the invention, with its channels 14, is capable of better vapor-phase and liquid-phase perspiration dissipation with respect to the fabric cited above and with respect to the other similar known types of fabrics.

As regards the dissipation of vapor-phase perspiration, the channels 14 in fact allow the perspiration to move continuously upwardly from below, rising along said channels 14, which are conveniently oriented predominantly vertically; the channels 14 provide the preferential passages cited above in which the vapor-phase perspiration does not encounter obstacles to its rise and is therefore not likely to condense in the fabric 10, as instead occurs in the known fabrics or items of clothing described above.

Moreover, the first inner layer 11, which is substantially hydrophobic instead of being hydrophilic, facilitates the passage (instead of hindering it, as would occur with a first hydrophilic layer) of liquid perspiration from the body of the user toward the second intermediate layer 12 and toward the overlying third outer layer 13.

Figure 6:
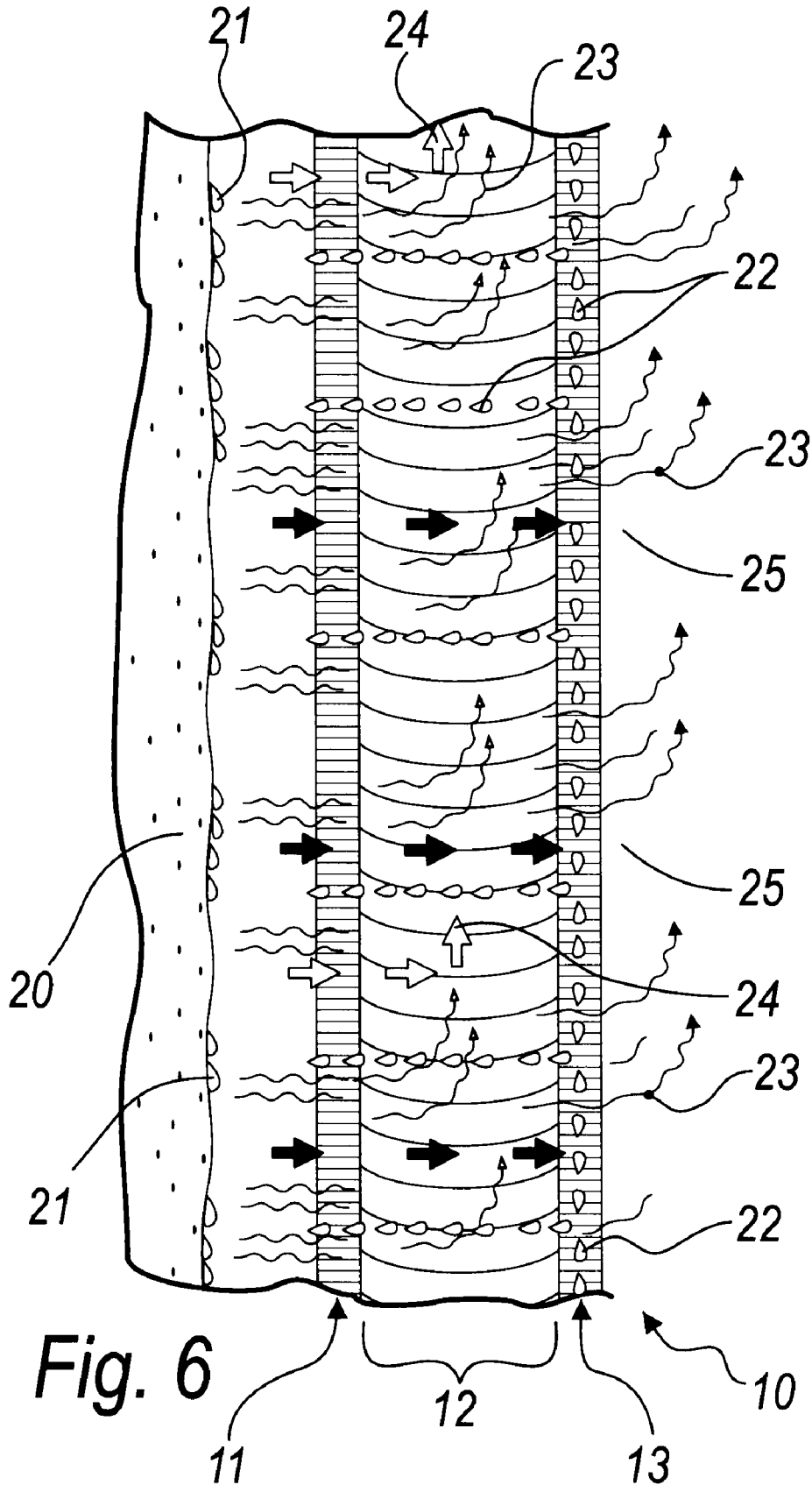
FIG. 6 is a schematic sectional view of a portion of an improved fabric according to the invention, proximate to the skin of a user.

The operation of the improved fabric 10 according to the invention is exemplified for the sake of greater clarity in FIG. 6.

Liquid-phase perspiration, represented schematically by the droplets 21, flows out from the skin 20 of a user.

Depending on the temperature and pressure conditions outside the body of the user, the liquid-phase perspiration 21 partly evaporates due to the heat of the skin itself and partly remains in the liquid phase.

The vapor-phase perspiration, shown by means of the wavy lines 23, passes through the first layer 11 and, by means of the channels 14 of the second layer 12, is facilitated in its ascending motion, which makes it rise by following the path indicated by the light-colored arrows 24.

The liquid-phase perspiration 21 which is present on the improved fabric 10 originates either directly from the skin 20 or from the condensation of vapor-phase perspiration 23, which can occur within the improved fabric 10 if the temperature and pressure conditions outside the item of clothing are such, with respect to the pressure and temperature between the skin 20 and the first layer 11, as to cause this state transition.

These differences in temperature and pressure make the liquid-phase perspiration 21 pass through the first layer 11, which is hydrophobic and therefore suitable to allow the transit of the liquid and then, by virtue of the same mechanism, make it pass through the ribs 15 of the second intermediate layer 12 until it reaches the third outer hydrophilic layer 13, where it diffuses, arranging itself on the larger available surface.

The path of the liquid-phase perspiration 21 is indicated by the dark arrows 25.

From the third layer 13, the liquid-phase perspiration can evaporate and in any case remains spaced from the first layer 11 and therefore in a position in which it is not in contact with the skin 20 of the user, said contact typically generating feelings of discomfort.

Such an improved fabric 10 according to the invention has a modest thickness and is soft and pleasant to the touch, and therefore has an improved fit and is physiologically more comfortable than known fabrics.

The improved fabric 10 can therefore be used well to produce the most disparate items of clothing, from technical gear for mountain sports to winter or sports jackets and even underwear.

Figure 2:
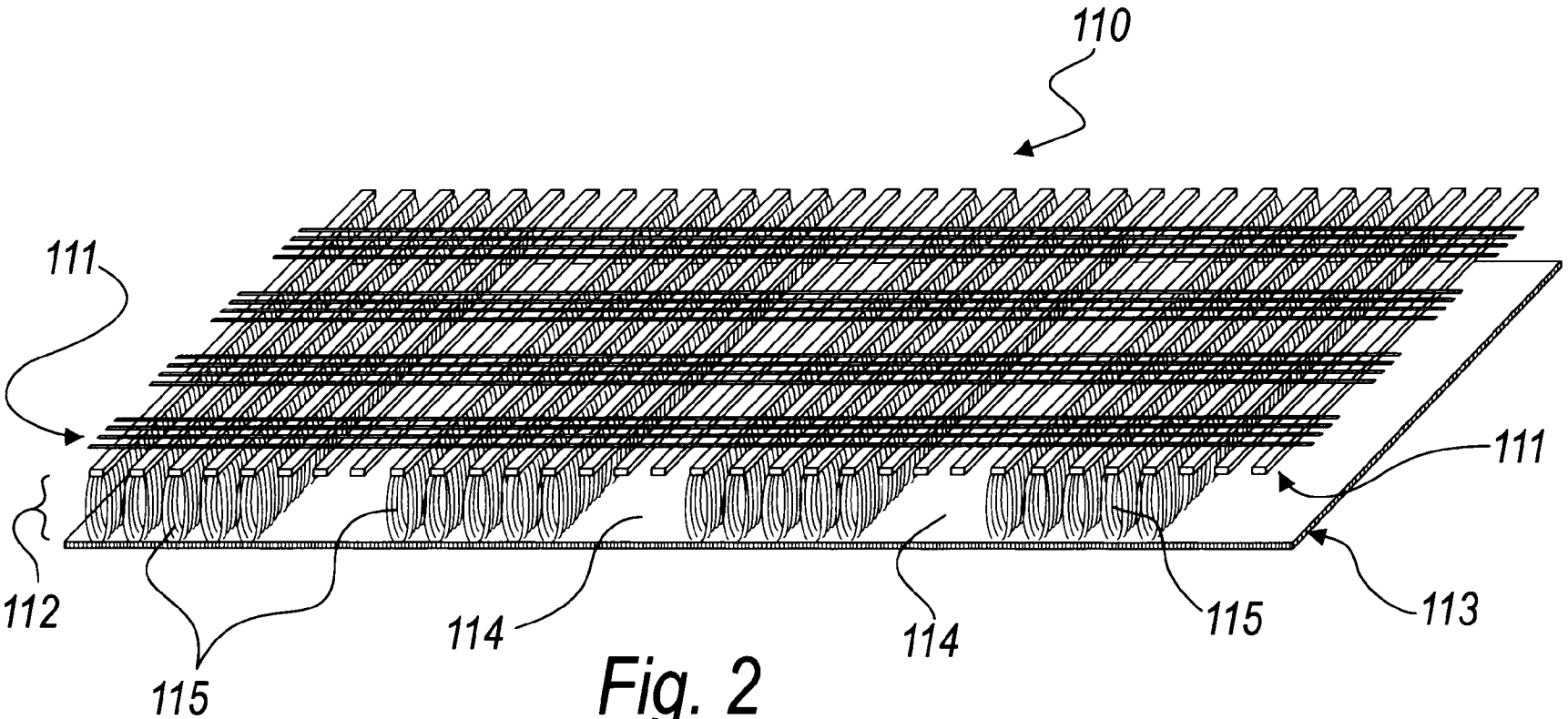
FIG. 2 is a schematic perspective view of an improved fabric according to the invention in a second embodiment thereof.

In a second embodiment of the invention, shown in FIG. 2 and designated by the reference numeral 110 therein, the fabric 110 is characterized in that the first inner breathable layer 111 is constituted, above the ribs 115 of the second layer 112, by a finely perforated continuous fabric.

The third outer layer 113 is again of the hydrophilic type, in a manner which is fully similar to what has been described for the first embodiment of the invention.

In said improved fabric 110 there are again the ribs 115, which define the channels 114, which form the preferential passages for the vapor-phase perspiration; differently from the first embodiment, they are affected by the microperforated fabric which provides the first inner layer 111.

Such first inner layer 111 therefore has a larger surface area for contact with the body of the user with respect to the similar limited area provided by the strips 16 that provide the first layer 11 of the first embodiment of the improved fabric 10 according to the invention.

Figure 3:
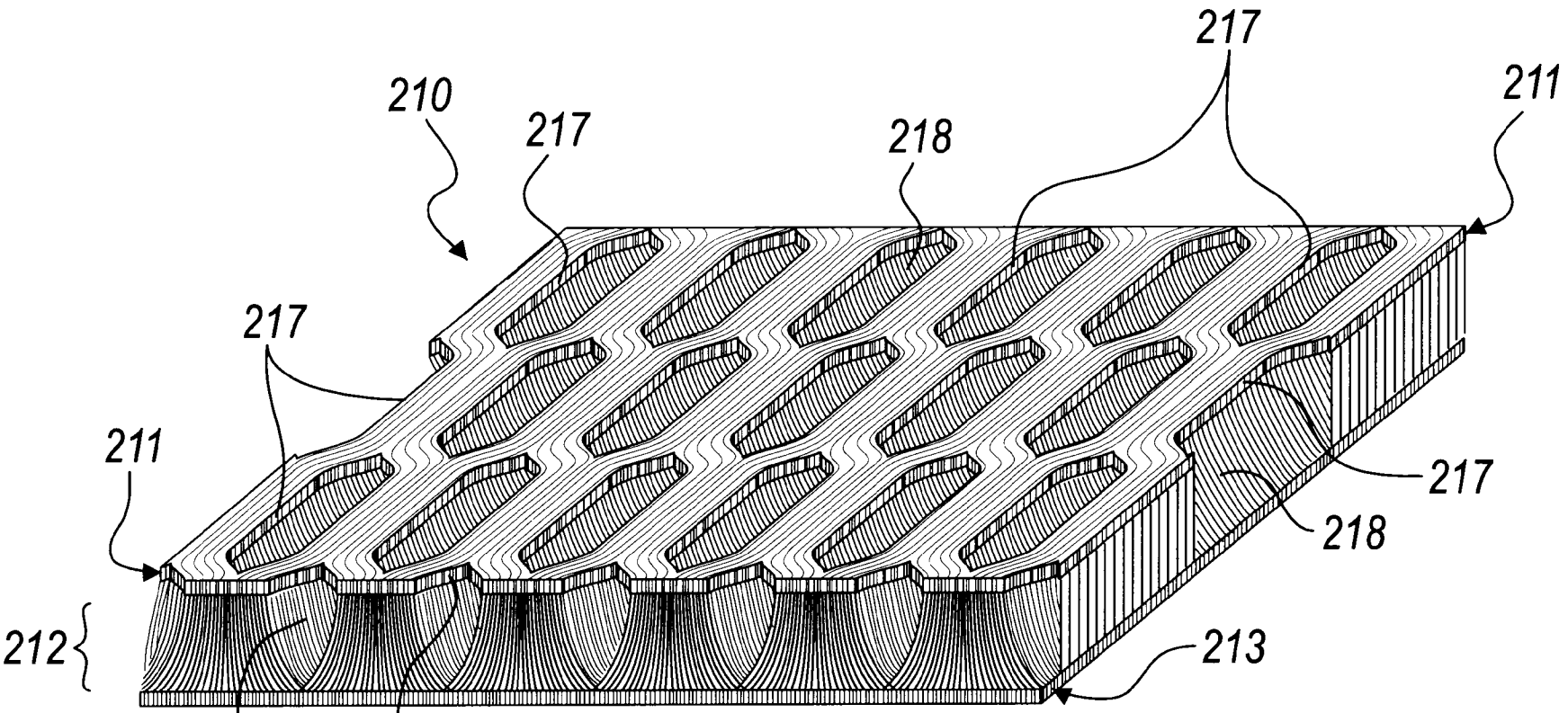
FIG. 3 is a schematic perspective view of an improved fabric according to the invention, in a first variation of a third embodiment thereof.
Figure 4:
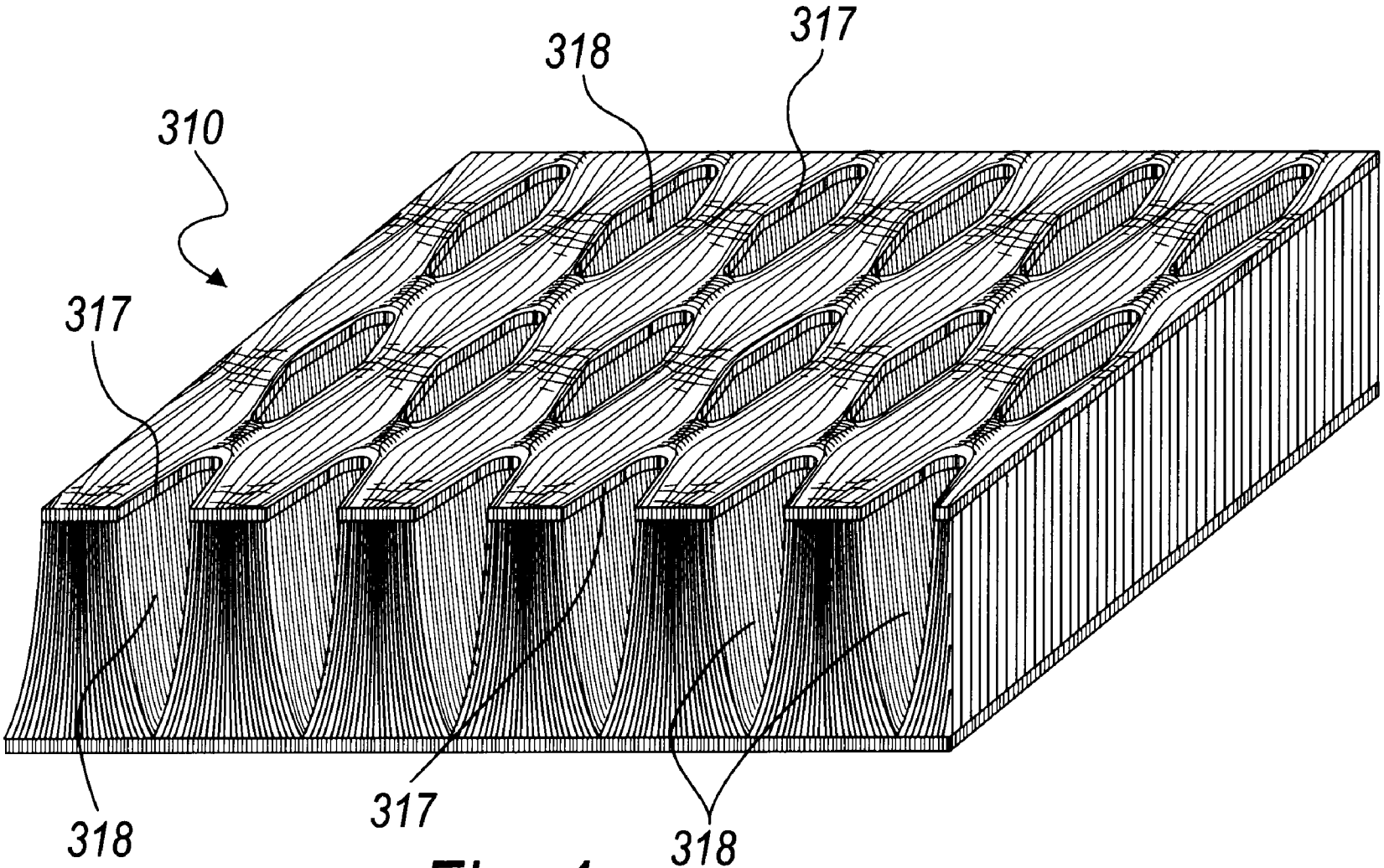
FIG. 4 is a schematic perspective view of an improved fabric according to the invention, in a second variation of its third embodiment.

A third embodiment of the invention is shown in two variations thereof in FIGS. 3 and 4.

In a first variation of said third embodiment of a fabric according to the invention 210, the first inner breathable layer 211 is constituted by a diffusely macroperforated fabric.

The second layer 212 lies between the first layer 211 and the third layer 213 (which has hydrophobic characteristics as in the embodiments described above), so as to not affect the holes 217 of the macroperforated fabric which forms the first layer 211.

The holes 217 and the corresponding openings 218 in the second layer 212 form the preferential passages for the outflow of the vapor-phase perspiration from the first layer 211 outwardly.

In the fabric embodiment 210, the channels 14, 114 of the preceding first and second embodiment 10 and 110 are replaced by series of openings 218 which are arranged sequentially and staggered along parallel lines, so as to form an overall structure of the second layer 212 which is substantially mesh-like.

The first layer 211, which is perforated with substantially hexagonal holes 217 so as to cover the geometric pattern of the second layer 212, has an area designed for contact with the body of a user which has a smaller surface than the similar surface of the second embodiment and at the same time is a more continuous contact surface than the first embodiment of the invention provided with ribs and channels.

In the second variation of the third embodiment of the invention, designated in FIG. 4 by the reference numeral 310, the holes 317, which are substantially diamond-shaped, and the openings 318 are provided along lines which are parallel both in a first direction and in a second direction which is perpendicular to the first direction along the same plane of arrangement as the first layer.

Figure 5:
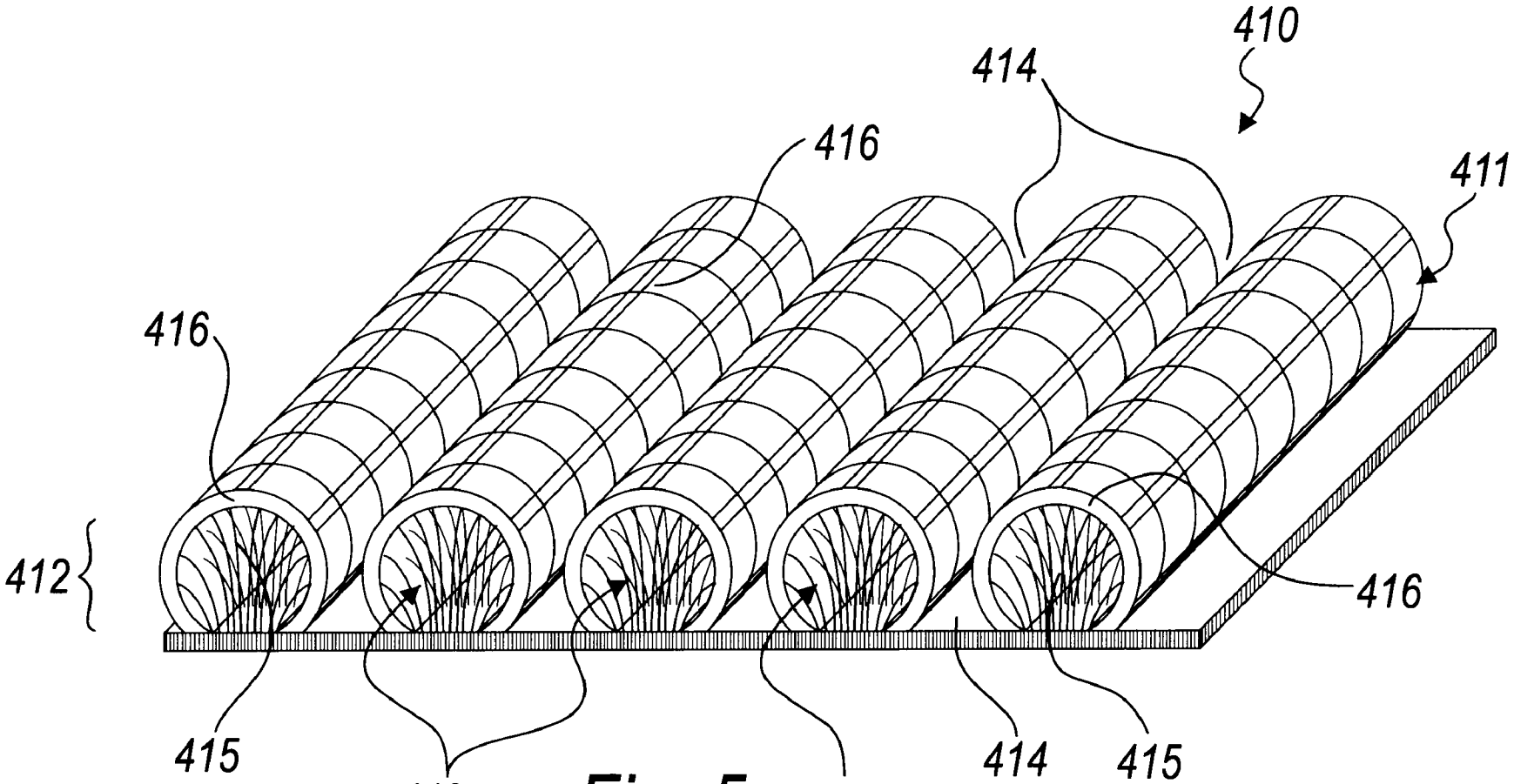
FIG. 5 is a schematic perspective view of an improved fabric according to the invention in a fourth embodiment thereof.

In a fourth embodiment of the invention, shown schematically in FIG. 5 and designated therein by the reference numeral 410, the ribs 415 of the second layer 412 are surrounded by corresponding portions 416 of the first layer 411, so as to form substantially tubular parallel elements 419 between which the channels 414 are formed, providing the preferential passages for the vapor from the first layer 411 outwardly which facilitate the rise of the vapor from the lower region of the item of clothing upwardly.

The ribs 15 with the strips 16 of the first embodiment 10 of the invention, as well as the ribs 415 with the first-layer portions 416 which correspond thereto of the fourth embodiment of the invention 410, form a total surface of the first layer 11 or 411 designed for contact between the fabric 10 or 410 and the body of a user which can be equal to, or smaller than, 50% of the total area of the fabric 10 or 410 which is directed toward the user.

The improved fabric 10 or 410 having a reduced contact surface allows easy wearing of the item of clothing, reducing friction between the item and the body of the user.

The improved fabric in the embodiments described here can comprise a percentage by weight of hydrophilic fibers between a minimal range of 8% to 15% and a maximum range of 60% to 75%.

The fabric can be constituted, for example, by 11% hydrophilic nylon and 89% polyester, for a weight of 340±5 g/m$^2$.

The improved fabric according to the invention can further have, on said third layer and outside it, a fourth layer which has technical functions or bears distinctive, decorative or ornamental markings.

Said fourth layer, not shown for the sake of simplicity, is joined to the underlying third layer by means of spots of glue or other equivalent means.

Said fourth layer, for example, can comprise a waterproof and breathable membrane.

The improved fabric according to the invention allows, as mentioned, to convey the perspiration in liquid form and/or in vapor form outwardly from the body of the user of the item of clothing.

The operating principle of said improved fabric, in all its embodiments, takes the name of "push-pull" effect, since the perspiration is pushed by the first hydrophobic layer towards the third hydrophilic layer, which absorbs it (pulls it) and then makes it evaporate.

The great difference in humidity between the first inner layer which is adjacent to the skin and the environment guides, as mentioned, the outward movement of the perspiration.

By providing an item of clothing or a shoe with the described improved fabric, the perspiration produced by the human body is not retained by the first inner layer, which remains dry.

Liquid-phase perspiration is conveyed through the second spacing layer, while the vapor-phase perspiration is conveyed along the channels or openings of said second layer, which are conveniently oriented within the item of clothing, said second layer forming an interspace which is composed of a plurality of channels or a plurality of openings.

After their arrival in the third outer layer, the liquid-phase perspiration is distributed on said layer, from which it can evaporate easily.

Neither the first inner layer of the improved fabric nor the monofilament threads which constitute the second intermediate layer absorb perspiration, since they are both hydrophobic, but they direct the vapor-phase perspiration and warm air, through a sort of air space or chamber, toward the third outer hydrophilic layer, which absorbs all the liquid-phase perspiration, making it evaporate toward the outside environment.

The item of clothing is therefore capable of dissipating the warm air, the vapor-phase perspiration and the liquid-phase perspiration.

The conveyance of the humidity from the body toward the outside environment increases the level of comfort of the item of clothing, avoiding or minimizing the formation of wet areas in the layers that lie closest to the body of the user.

In practice it has been found that the invention thus described solves the drawbacks noted in the items of clothing and fabrics of the prior art.

In particular, the present invention provides an improved fabric particularly for items of clothing and shoes which is capable of better dissipation of liquid-phase and vapor-phase perspiration with respect to the fabric of the prior art and with respect to other similar fabrics of the known kind.

Moreover, the present invention provides an improved fabric which allows a better fit and is physiologically more comfortable.

Moreover, the present invention provides an improved fabric which can be adopted to produce the most disparate items of clothing, from technical gear for mountain sports to winter or sports jackets and even underwear.

Moreover, the present invention provides an improved fabric which allows natural thermoregulation of the body of the user of the item obtained with said fabric.

Moreover, the present invention provides an improved fabric which can be produced inexpensively with known systems and technologies.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to requirements and to the state of the art.

The disclosures in Italian Patent Application No. PD2006A000098 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A fabric particularly for items of clothing and shoes, comprising:

a first inner layer, to be directed toward the body of the user, which is substantially hydrophobic and breathable and is suitable to direct liquid-phase and vapor-phase perspiration away from the user of an item of clothing or the like produced with said fabric; and a second intermediate spacing layer, which is substantially hydrophobic and transfers the liquid-phase perspiration from said first inner layer toward a third outer layer and defines preferential passages for vapor-phase perspiration from said first layer outwardly, wherein the third outer layer is substantially hydrophilic and is suitable for permeation of vapor-phase perspiration, for absorbing liquid phase perspiration that arrives from the first layer, and for distributing said liquid-phase perspiration over a large surface thereof so that it can evaporate outwardly, wherein said layers are joined so as to form a single body, wherein said preferential passages formed in said second intermediate layer are provided by a plurality of channels, said channels are arranged substantially vertically and are configured to facilitate the rise of vapor-phase perspiration from the lower region of the item of clothing upwardly, wherein the preferential passages are formed by parallel substantially tubular elements, between which said channels are formed, which are suitable to provide for the vapor-phase perspiration from said first layer outwardly and facilitate the rise of the vapor-phase perspiration from the lower region of the item of clothing upwardly, and wherein a total surface of said first layer which is designed for contact between said fabric and the body of a user which can be equal to, or smaller than, 50% of the total area of the fabric which is directed toward the user.

2. The fabric according to claim 1, wherein said plurality of channels are formed by a plurality of parallel ribs.

3. The fabric according to claim 2, wherein said first inner layer is formed by strips of hydrophobic fabric, each of which is arranged so as to affect a corresponding rib of said ribs.

4. The fabric according to claim 1, wherein said first layer is made of hydrophobic fibers of polyester or polypropylene or other equivalent hydrophobic fibers.

5. The fabric according to claim 4, wherein said first layer is a monofilament polyester fabric with a fiber gage of approximately 150 denier.

6. The fabric according to claim 2, wherein said second intermediate layer is made of hydrophobic fibers of polyester or polypropylene or other equivalent hydrophobic fibers.

7. The fabric according to claim 6, wherein said second hydrophobic layer is made of polyester monofilaments with a fiber gage of approximately 30 denier.

8. The fabric according to claim 7, wherein said monofilaments of said second layer are interwoven with the first layer and the third layer, so as to form said ribs.

9. The fabric according to claim 3, wherein said ribs of the second layer, joined to the corresponding strips of the first layer, have a thickness preferably in the range from 3 to 4 millimeters.

10. The fabric according to claim 9, wherein said strips of fabric of the first layer have preferably a width of approximately 4 millimeters.

11. The fabric according to claim 10, wherein said channels have an average width, between two successive ribs, of 3 to 8 millimeters.

12. The fabric according to claim 11, wherein said channels have an average width of 4 millimeters.

13. The fabric according to claim 1, wherein said third breathable and substantially hydrophilic layer contains fibers of at least one hydrophilic material selected among cotton, linen, cellulose, plastics, or other equivalent fibers.

14. The fabric according to claim 13, wherein said third hydrophilic layer contains modified polyamide fibers, selected from the group consisting of 6-nylon and 66-nylon.

15. The fabric according to claim 13, wherein said third hydrophilic layer contains composite mixed fibers of modified polyamide and polyester.

16. The fabric according to claim 13, wherein said third layer comprises a combination of first monofilaments of mixed fibers with second polyester monofilaments.

17. The fabric according to claim 16, wherein said first monofilaments made of mixed fibers are made of modified polyamide and polyester and said second monofilaments are made of polyester.

18. The fabric according to claim 17, wherein said first mixed-fiber monofilaments have a fiber gage of approximately 90 denier, while said second monofilaments made of polyester have a fiber gage of approximately 150 denier.

19. The fabric according to claim 1, wherein said first inner breathable layer is constituted by a finely perforated continuous fabric.

20. The fabric according to claim 1, wherein said first inner breathable layer is constituted by a diffusely macroperforated fabric.

21. The fabric according to claim 20, wherein said second layer lies between the first layer and the third layer so as to not affect the holes of the macroperforated fabric which forms said first layer.

22. The fabric according to claim 21, wherein said holes and the corresponding openings in the second layer form said preferential passages for the vapor from said first layer outwardly.

23. The fabric according to claim 2, wherein the ribs of said second layer are surrounded by corresponding portions of said first layer so as to define the parallel substantially tubular elements.

24. The fabric according to claim 3, wherein said ribs with the strips or with the first layer portions which correspond to them form a total surface of said first layer which is designed for contact between said fabric and the body of a user which can be equal to, or smaller than, 50% of the total area of the fabric which is directed toward the user.

25. The fabric according to claim 3, wherein a percentage by weight of the hydrophilic fibers which is comprised between a minimum range of 8% to 15% and a maximum range of 60% to 75%.

26. The fabric according to claim 3, constituted by 11% hydrophilic nylon and 89% polyester, for a weight of 340±5 $g/m^2$.

27. The fabric according to claim 1, wherein a fourth layer with technical functions or provided with distinctive, decorative or ornamental characters is laminated onto said third layer and on its outside.

28. The fabric according to claim 27, wherein said fourth layer is joined to the underlying third layer by means of spots of glue or other equivalent means.

29. The fabric according to claim 28, wherein said fourth layer comprises a waterproof breathable membrane.

* * * * *